US005653051A

United States Patent [19]

Pons et al.

[11] Patent Number: 5,653,051

[45] Date of Patent: Aug. 5, 1997

[54] PROCESS AND SYSTEM TO BRAKE THE MOVEMENT OF A PART COCKED BY A SPRING AND FIREARM HAVING SUCH A SYSTEM

[75] Inventors: René Pons, St Etienne; Jean-Pierre Montgrenier, Veauche, both of France

[73] Assignee: Giat Industries, Versailles, France

[21] Appl. No.: 490,159

[22] Filed: Jun. 14, 1995

[30] Foreign Application Priority Data

Jun. 16, 1994 [FR] France ..... 94 07356

[51] Int. Cl.[6] ..... F41A 3/00

[52] U.S. Cl. ..... 42/69.03; 89/129.01; 89/131

[58] Field of Search ..... 42/69.03; 89/129.01, 89/130, 131

[56] References Cited

U.S. PATENT DOCUMENTS

| | | | |
|---|---|---|---|
| 2,459,158 | 1/1949 | Garand | 89/129.01 |
| 2,622,359 | 12/1952 | Belleri | 42/69.03 |
| 2,791,942 | 5/1957 | Fletcher | 89/131 |
| 3,015,993 | 1/1962 | Franchi | 89/130 |
| 3,301,133 | 1/1967 | Sturtevant | 89/130 |
| 3,724,325 | 4/1973 | Silsby | 89/131 |
| 4,523,509 | 6/1985 | Thevis et al. | 89/129.02 |
| 5,280,683 | 1/1994 | Ping | 42/69.03 |

*Primary Examiner*—J. Woodrow Eldred
*Attorney, Agent, or Firm*—Oliff & Berridge

[57] ABSTRACT

A process to brake a part of a mechanism includes applying a first torque, applying a second torque and braking the part. The mechanism is urged to alternatingly swivel along a path in a first direction from a first position to a second position by a spring connected to the part. The first torque is applied to the part with the spring to swivel the part in a first direction from the first position to the second position. The first torque is defined by a strain-release force of the spring in a tensed position. The second torque is applied to the part with the spring in a second direction opposite the first direction. The second torque is less than the first torque and is defined by the strain-release force of the spring. The part is braked along at least a part of the path. As a result, the motion of the part can be slowed simply and inexpensively.

20 Claims, 1 Drawing Sheet

PROCESS AND SYSTEM TO BRAKE THE MOVEMENT OF A PART COCKED BY A SPRING AND FIREARM HAVING SUCH A SYSTEM

BACKGROUND OF THE INVENTION

The subject of the present invention is a process and apparatus to brake the movement of a part that is cocked by a spring and has an alternating swivelling movement.

The scope of application of the invention is notably, but not exclusively, that of small-caliber automatic firearms, and the part to be braked is the hammer of the functioning mechanism of the arm.

A firearm of the above-mentioned type may fire at a rate of 1200 rounds per minute, for example, and the problem which arises is reducing the firing rate to increase firing accuracy of the firearm.

Known systems to decrease the firing rate of a small-caliber automatic firearm are based on the inertia of triggered dead heads or on clockwork systems. In the case of triggered dead heads, a large volume must be available to ensure the movement of the dead heads, whereas a clockwork system is extremely complex. As a result, neither of these two systems is easy to implement.

SUMMARY OF THE INVENTION

An aim of the invention is to provide a new solution to the problem of slowing down a part having an alternating swivelling movement, such as the hammer of a firearm, and for which the implementation is simple and inexpensive.

To this end, the process of the invention includes braking the movement of a part cocked by a spring and having an alternating swivelling movement around a support shaft by applying:

- a first torque defined by the strain-release force exerted by the spring, in its tensed position, to impart a movement to the part from its first to its second position, and
- a second torque also defined by the strain-release force of the spring, but of a lesser value, to oppose the action of the first torque to brake the part along at least one part of its course from its first to its second position, the part thereafter returning to its first position under the action of another driving component.

According to another characteristic of this process, the second torque is applied via a second swivelling part that contacts the part to be braked.

The invention also includes a system having a second part or braking part, mounted to swivel around a shaft and linked to the part to be braked by a linking rod extending perpendicularly to two support shafts and parallel to the two parts, the linking rod being hinged to the part to be braked and freely passing through an opening in the braking part. A cocking spring is mounted around the linking rod to contact the braking part and a boss on the linking rod. Because the support shafts of the part to be braked and the braking part are located at different distances from the longitudinal axis of the linking rod, the restoring force of the cocking spring, in its tensed position when the part to be braked is in its first position, is applied simultaneously to the two parts. As a result, opposing torques are produced that slow down the movement of the part to be braked along at least one part of its course towards its second position.

As a general rule, the process and the system in accordance with the invention may be applied to a small-caliber firearm, where the part to be braked is the hammer of the functioning mechanism of this firearm.

Thus, it is possible to reduce the firing rate of the firearm in order to increase firing accuracy, without having to fundamentally modify the mechanism of the firearm.

BRIEF DESCRIPTION OF THE DRAWINGS

Other advantages, characteristics and details of the invention will become clear from the explanatory description which follows, made in reference to the appended drawings which are given exclusively by way of illustration and in which.

DETAILED DESCRIPTION OF PREFERRED EMBODIMENTS

Figure 1:
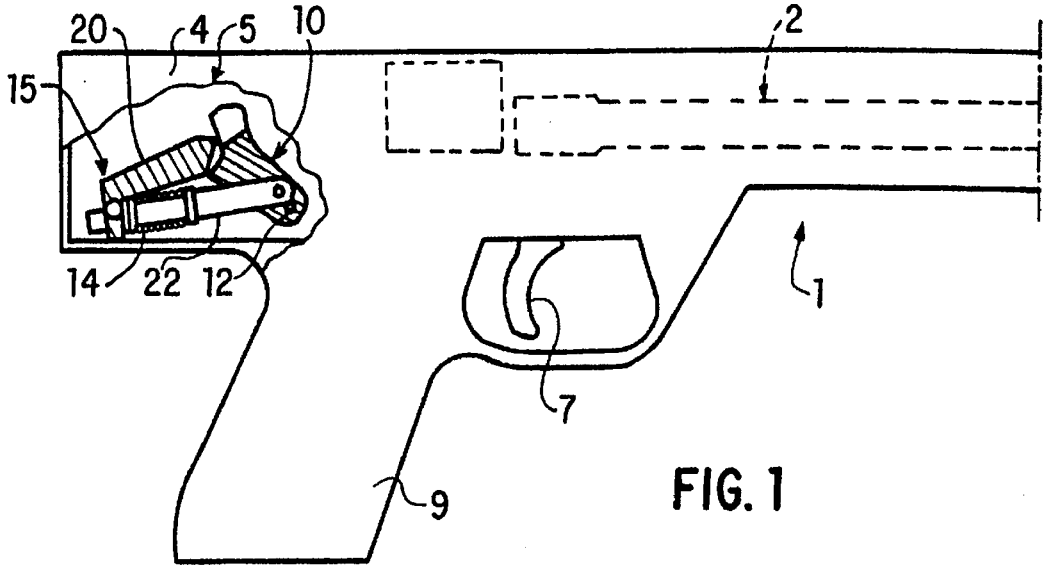
FIG. 1 is a skeleton drawing, partly truncated, of a firearm in which the firing mechanism is fitted with a braking system according to the invention.

The firearm 1, as shown in FIG. 1, is a small-caliber automatic weapon that includes a barrel assembly 2, a butt 4 that houses a mechanism 5 to control the functioning of the weapon, a trigger 7 linked to the mechanism 5 and a grip 9 for a user to hold the weapon 1.

The mechanism 5 includes a hammer 10 mounted to swivel around a shaft 12 of the body of the firearm 1. The hammer 10 alternatingly swivels between a cocked position and a firing position when the trigger 7 is pulled by the finger of the user.

The hammer 10 is cocked by a spring 14 when the hammer 10 is in its cocked position. The hammer 10 engages a sear (not shown), which is controlled by the trigger 7 and which maintains the hammer 10 in a cocked position until the sear has been activated.

A braking system 15 enables the movement of the hammer 10 to be slowed as its moves from its firing position under the action of the force exerted by the cocking spring 14 once the sear is no longer engaged with the hammer 10.

The braking system 15 is based on the action exerted on the hammer 10 by two opposite or opposing torques that are simultaneously applied to the hammer 10 and defined by the force exerted by the cocking spring 14.

Figure 2:
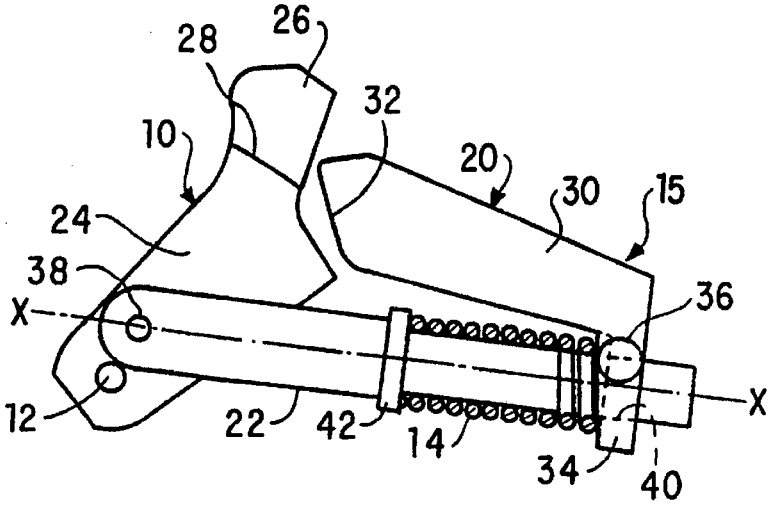
FIG. 2 and FIG. 3 are skeleton drawings that illustrate the operation of the system shown in FIG. 1.
Figure 3:
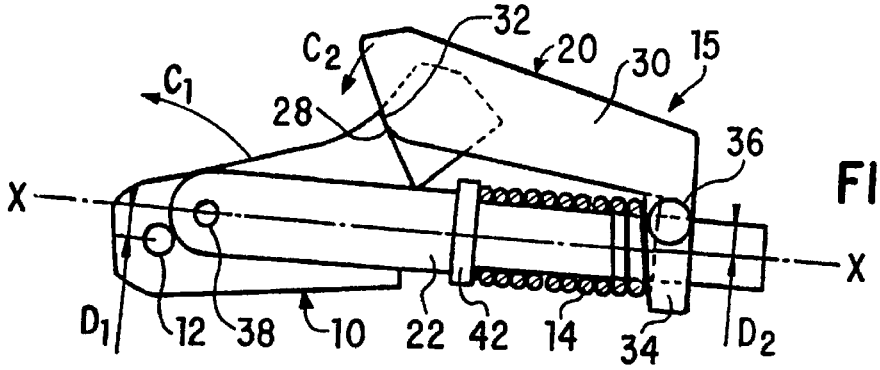

More precisely, with reference to FIGS. 2 and 3, the braking system includes a braking part 20 designed to contact the hammer 10 when the hammer 10 is in its cocked position. A first torque C1 is applied on the hammer 10, whereas a second opposing torque C2 (C2<C1) is simultaneously applied by the braking part 20 on the hammer 10.

The braking system 15 also includes a linking rod 22 mounted between the hammer 10 and the braking part 20. The linking rod 22 holds the cocking spring such that the force of the spring 14, which is simultaneously applied to the hammer 10 and to the braking part 20, creates the torques C1 and C2.

The hammer 10 includes a body 24 of which one end is hinged to the shaft 12 and the other end forms a firing pin element 26. A bearing surface 28 is formed, by a retracted part forming a shoulder, between the body 24 and the firing pin element 26 of the hammer 10.

The braking part 20 includes a body 30 in which one end forms a bearing surface 32 and the other end extends, at an angle of approximately 90°, to form a heel 34 located in the same plane as the body 30. The braking part 20 is mounted to swivel around a shaft 36 that is attached to the body of the weapon 1 and is perpendicular to the pivot shaft 12 of the hammer 10.

The hammer 10 and the braking part 20 are disposed in the same plane parallel to the plane of symmetry of the weapon 1 along the barrel assembly 2.

The linking rod 22 of the braking system 15 is pivotably mounted at one of its ends to the hammer 10 on a shaft 38. The shaft 38 is parallel to the pivot shafts 12 and 36 of the hammer 10 and of the braking part 20, respectively. The other end of the linking rod 22 passes freely through an opening 40 made in the heel 34 of the braking part 20. A collar or boss 42 is disposed on the central part of the linking rod 22, and the cocking spring 14 of the hammer 10 is mounted around the rod 22 so that the two ends of the cocking spring 14 contact the boss 42 and the braking part 20, respectively.

The force of the cocking spring 14 is therefore applied simultaneously on the hammer 10 at a point delimited by the shaft 38 mounted between the hammer 10 and the rod 22, and on the braking part 20 at a point located on the heel 34 of the body 30. These two application points are located on the longitudinal axis X—X of the linking rod 22. The pivotal axes of the hammer 10 and of the braking part 20, delimited by the shafts 12 and 36, are respectively located at distances D1 and D2 (D1>D2) from the axis X—X.

The functioning principle of the slowing device 30 will be described with reference to FIG. 3.

When the hammer 10 is in its cocked position, its bearing surface 28 is in contact with the bearing surface 32 of the braking part 20, and the cocking spring 14 is its tensed position. The force of the cocking spring 14 is applied simultaneously and with the same strength to the hammer 10 and to the braking part 20. This force creates the first torque C1 which is applied to the hammer 10 and which tends to make it swivel towards its firing position, and creates the second opposing torque C2 that is also applied to the hammer 10 by the braking part 20 and that tends to oppose the action exerted by the torque C1. In these circumstances, as long as the braking part 20 contacts the hammer 10, the resulting torque applied to the hammer 10 is equal to the difference between the two torques C1 and C2. As a result, the movement of the hammer 10 is slowed down over at least part of its course towards its firing position. The bearing surfaces 28 and 32 of the hammer 10 and of the braking part 20 are dimensioned to remain in contact with one another over at least part of the rotation of the hammer 10. By altering the dimensions of the bearing surfaces 28 and 32 and the values of the torques C1 and C2, the rate at which the hammer 10 is slowed may be adjusted.

The return movement of the hammer from its firing position to its cocked position is achieved, for example, by moving the mechanism 5 of the weapon.

As a general rule, this braking system 15, for which an example of its application has been given for the functioning mechanism of a firearm, may be applied to devices in other fields in which it is necessary to slow down the swivelling movement of a part.

We claim:

1. A process to brake a part of a mechanism that is urged to alternatingly swivel along a path in a first direction from a first position to a second position by a spring connected to said part, said process comprising the steps of:

applying a first torque to said part with said spring to swivel said part in said first direction from said first position to said second position, said first torque being defined by a strain-release force of said spring in a tensed position;

applying a second torque to said part with said spring in a second direction opposite said first direction while said part swivels between said first position and said second position, said second torque being less than said first torque and defined by the strain-release force of said spring; and continuously braking said part along said path, said path defined by the engagement of said part with a braking part.

2. The process of claim 1, wherein said mechanism includes a driving member connected to said part, said process further comprising returning said part from said first position to said second position with said driving member.

3. The process of claim 1, wherein said mechanism includes a braking part, and wherein said step of applying a second torque includes contacting said part with said braking part.

4. The process of claim 3, wherein said step of braking includes urging said braking part in said second direction against said part.

5. A braking system comprising:

a part disposed to alternatingly swivel about a first support shaft over a path between a first position and a second position;

a braking part disposed to swivel about a second support shaft and to continuously engage said part in said first position and along at least a portion of said path;

a linking member having a first end a second end and a longitudinal axis, said linking member being hingedly connected at said first end to said part and operatively connected at said second end to said braking part; and a spring disposed along said longitudinal axis that approximately simultaneously exerts a force on said part and said braking part.

6. The braking system of claim 5, wherein said part includes a first connecting shaft and said first end includes a connecting shaft aperture dimensioned to receive said first connecting shaft, said connecting shaft aperture intersecting said longitudinal axis of said linking member.

7. The braking system of claim 5, wherein said spring is disposed around said linking member.

8. The braking system of claim 7, wherein said linking element includes a boss disposed between said first end and said second end, and wherein said boss engages one end of said spring to prevent said spring from moving toward one of said first end and said second end while said spring is in a tensed position.

9. The braking system of claim 5, wherein said braking part includes an opening dimensioned larger than said second end such that said opening is positionable over said second end and said braking part is swivelable about said second support shaft to engage said spring.

10. The braking system of claim 5, wherein said first support shaft extends from a first fixed point.

11. The braking system of claim 5, wherein said second support shaft extends from a second fixed point.

12. The braking system of claim 5, wherein a first distance from said first support shaft to said longitudinal axis is greater than a second distance from said second support shaft to said longitudinal axis.

13. A firearm having a braking system for a hammer mechanism disposed within a body of said firearm, said braking system comprising:

a hammer disposed to alternatingly swivel about a first support shaft over a path between a first position and a second position;

a braking part disposed to swivel about a second support shaft and to continuously engage said hammer in said first position and along said path;

a linking member having a first end, a second end and a longitudinal axis, said linking member being hingedly connected at said first end to said hammer and operatively connected at said second end to said braking part; and a spring disposed along said longitudinal axis that approximately simultaneously exerts a force on said hammer and said braking part.

14. The firearm of claim 13, wherein said hammer includes a first connecting shaft and said first end includes a connecting shaft aperture dimensioned to receive said first connecting shaft, said connecting shaft aperture intersecting said longitudinal axis of said linking member.

15. The firearm of claim 13, wherein said spring is disposed around said linking member.

16. The firearm of claim 15, wherein said linking element includes a boss disposed between said first end and said second end, and wherein said boss engages one end of said spring to prevent said spring from moving toward one of said first end and said second end while said spring is in a tensed position.

17. The firearm of claim 13, wherein said braking part includes an opening dimensioned larger than said second end such that said opening is positionable over said second end and said braking part is swivelable about said second support shaft to engage said spring.

18. The firearm of claim 13, wherein said first support shaft extends from said body.

19. The firearm of claim 13, wherein said second support shaft extends from said body.

20. The firearm of claim 13, wherein a first distance from said first support shaft to said longitudinal axis is greater than a second distance from said second support shaft to said longitudinal axis.

* * * * *